US007699108B2

(12) United States Patent
Bane et al.

(10) Patent No.: US 7,699,108 B2
(45) Date of Patent: Apr. 20, 2010

(54) DISTORTION COMPENSATION FOR ROD PISTON BORE IN SUBSURFACE SAFETY VALVES

(75) Inventors: Darren E. Bane, Broken Arrow, OK (US); David Z. Anderson, Glenpool, OK (US); Alan N. Wagner, Broken Arrow, OK (US); Clifford H. Beall, Broken Arrow, OK (US); Gary B. Lake, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 177 days.

(21) Appl. No.: 11/595,591

(22) Filed: Nov. 13, 2006

(65) Prior Publication Data

US 2008/0110631 A1 May 15, 2008

(51) Int. Cl.
*E21B 34/10* (2006.01)

(52) U.S. Cl. ..... 166/319; 166/321

(58) Field of Classification Search ..... 166/319, 166/321

See application file for complete search history.

(56) References Cited

U.S. PATENT DOCUMENTS 3,971,438 A 7/1976 Crowe
4,042,023 A 8/1977 Fox
4,069,834 A 1/1978 Bern
4,103,744 A 8/1978 Akkerman
4,202,368 A 5/1980 Akkerman
4,399,871 A 8/1983 Adkins et al.
4,415,036 A 11/1983 Carmody
4,427,071 A 1/1984 Carmody
4,446,922 A 5/1984 Bowyer
4,457,376 A 7/1984 Carmody
4,467,867 A 8/1984 Baker
4,467,870 A 8/1984 Langham
4,478,288 A 10/1984 Bowyer
4,503,913 A 3/1985 Carmody
4,562,854 A 1/1986 Pringle et al.
4,565,215 A 1/1986 Cummings et al.

(Continued)

FOREIGN PATENT DOCUMENTS

FR 2702013 9/1994

OTHER PUBLICATIONS

Vinzant, M., et al., "A Unique Design for Deep-Set Tubing-Retrievable Safety Valves Increases Their Integrity in Ultra Deepwater Applications", SPE 90721, Sep. 1-9, 2004.

(Continued)

*Primary Examiner*—Hoang Dang
(74) *Attorney, Agent, or Firm*—Steve Rosenblatt

(57) ABSTRACT

Piston bore distortions in a sub-surface safety valve are reduced or eliminated when valve body is subjected to high working pressures. In one embodiment, a piston is disposed in a sleeve that is disposed in a piston bore. The bore can distort but the sleeve within will not distort to the point of losing sealing pressure around the piston. In another approach additional bore or bores are provided adjacent the piston bore to make the pin end of the connection for the valve housing more uniform in the region of the piston bore so that pressure loading does not result in sufficient distortion of the piston bore to lose the piston sealing relation in its bore.

13 Claims, 2 Drawing Sheets

U.S. PATENT DOCUMENTS

| | | | | |
|---|---|---|---|---|
| RE32,390 | E | 4/1987 | Pringle | |
| 4,669,547 | A | 6/1987 | Pringle | |
| 4,691,776 | A | 9/1987 | Pringle | |
| 4,796,705 | A | 1/1989 | Carmody | |
| 4,796,708 | A | 1/1989 | Lembcke | |
| 4,860,991 | A | 8/1989 | Blizzard et al. | |
| 4,923,012 | A | 5/1990 | Hopmann | |
| 4,944,351 | A | 7/1990 | Eriksen | |
| 4,945,993 | A | 8/1990 | Dickson et al. | |
| 4,951,753 | A | 8/1990 | Eriksen | |
| 4,967,845 | A | 11/1990 | Shirk | |
| 4,977,957 | A | 12/1990 | Pringle | |
| 5,004,007 | A | 4/1991 | Johnson et al. | |
| 5,211,243 | A | 5/1993 | Stratten | |
| 5,284,205 | A | 2/1994 | Smith | |
| 5,293,943 | A | 3/1994 | Williamson, Jr. | |
| 5,343,955 | A | 9/1994 | Williams | |
| 5,669,448 | A | 9/1997 | Minthorn et al. | |
| 5,713,423 | A | 2/1998 | Martin et al. | |
| 5,718,289 | A | 2/1998 | Schnatzmeyer et al. | |
| 5,862,864 | A | 1/1999 | Whiteford | |
| 5,897,095 | A | 4/1999 | Hickey | |
| 6,109,351 | A | 8/2000 | Beall | |
| 6,148,920 | A | 11/2000 | McCalvin | |
| 6,173,785 | B1 | 1/2001 | Adams | |
| 6,199,629 | B1 | 3/2001 | Shirk | |
| 6,237,693 | B1 | 5/2001 | Deaton | |
| 6,253,843 | B1 | 7/2001 | Rawson | |
| 6,269,874 | B1 | 8/2001 | Rawson | |
| 6,607,037 | B2 | 8/2003 | Thompson | |
| 6,742,595 | B2 * | 6/2004 | Dennistoun et al. | 166/375 |
| 6,902,006 | B2 | 6/2005 | Myerley | |
| 7,013,980 | B2 * | 3/2006 | Purkis et al. | 166/386 |
| 7,137,452 | B2 | 11/2006 | McVicker | |
| 7,409,996 | B2 | 8/2008 | Myerley et al. | |
| 7,493,956 | B2 | 2/2009 | Shaw et al. | |
| 2004/0040718 | A1 | 3/2004 | Rhodes et al. | |
| 2005/0098210 | A1 | 5/2005 | Strattan et al. | |
| 2006/0118307 | A1 * | 6/2006 | Williamson et al. | 166/321 |

OTHER PUBLICATIONS

Gazaq, N.M., "Modified SSSV for Oil Wells with Sanding Tendency", SPE 25552, Apr. 1993, 365-372.

Going, W.S., et al., "Safety Valve Technology for the 1990s", SPE 18393, Oct. 1988, 545-552.

Going, W.S. et al "Safety Valve Technology for the 1990's" SPE 16393 (1988).

Gazaq, N.M. et al "Modified SSSV for Oil Wells with Sanding Tendency" SPE 25552 (1993).

Vinzant, Mike et al "A Unique Design for Deep-Set Tubing-Retrievable Safety Valves increases Their integrity in Ultra Deepwater Applications" SPE 90721 (2004).

* cited by examiner

DISTORTION COMPENSATION FOR ROD PISTON BORE IN SUBSURFACE SAFETY VALVES

FIELD OF THE INVENTION

The field of this invention is downhole subsurface safety valves that operate a valve member with control line pressure delivered into a piston bore.

BACKGROUND OF THE INVENTION

Sub-surface safety valves (SSSV) are used in production tubing to control the well and to close it off to prevent a blowout. Typically, these valves have a disc shaped valve member that is known as a flapper. The flapper pivots over 90 degrees between an open and a closed position. A shiftable tube known as a flow tube is movable between two positions. When shifted down it engages the flapper to rotate it 90 degrees and keeps advancing as the flapper is moved into a position behind the flow tube. In this position the SSSV is open. A closure spring which was compressed as the flow tube opened the SSSV is used to return the flow tube to the original position. When the flow tube rises a pivot spring on the flapper urges it up against a seal surface to close off the production tubing.

Typically, a control line is run adjacent the production tubing from the surface to a piston bore in the SSSV. There are several types of pistons that can be used and they are generally linked to the flow tube such that applied and retained pressure in the control line acts on a piston that is linked to the flow tube to hold the flow tube down against a closure spring and keep the flapper in the open position. One common piston type is a rod piston called that because of its shape. Other piston types can have an annular shape. The rod piston sits in an elongated bore in a main housing component of the SSSV that usually terminates in a two step male thread also known as a pin. The pin is made up to a female thread called a box to fully assemble the SSSV.

More recently demand has been for SSSVs that have higher and higher internal working pressure ratings. These demanded working pressures have gone as high as 20,000-30,000 PSI. Testing of current designs under these conditions revealed that they could comfortably hold such working pressures but the presence of the piston bore in the pin part of the housing connection experienced dimensional distortion, generally becoming asymmetrical. The reason for this is that the pin is thinner than the box in the thread area. When the pressures get high enough, the pin deflects until a clearance comes out of the two step thread, at which time the pin and box move together. Thus, the problem that is addressed by the present invention is defined as how to keep the piston bore from distorting under high loads. Two approaches are presented. One involves a sleeve inserted into the piston bore so that bore distortions become irrelevant to the continuing ability of the piston to seal because the sleeve does not distort at all or to the point where a pressure seal around the piston is lost. Another approach is the creation of parallel bores to the piston bore so as to make the pin wall more uniform in strength in the vicinity of the piston bore to hold down or eliminate the distortion in the piston bore under loading to the point where the piston seal holds and the flow tube can continue to be powered down against a closure spring. These and other aspects of the present invention will become more apparent to those skilled in the art from a review of the preferred embodiment that is described below along with its associated drawings, recognizing that the full scope of the invention is to be found in the appended claims.

Injection bores in SSSVs have been used to deliver chemicals behind the flow tube as illustrated in U.S. Pat. No. 6,148,920 and US published application US 2005/0098210. Also relevant to SSSV in general are U.S. Pat. Nos. 4,042,023; 4,399,871; 4,562854; 4,565,215; 5,718,289 and 6,148,920 and US application 2004/0040718.

SUMMARY OF THE INVENTION

Piston bore distortions in a sub-surface safety valve are reduced or eliminated when valve body is subjected to high working pressures. In one embodiment, a piston is disposed in a sleeve that is disposed in a piston bore. The bore can distort but the sleeve within will not distort to the point of losing sealing pressure around the piston. In another approach, additional bore or bores are provided adjacent the piston bore to make the pin end of the connection for the valve housing more uniform in the region of the piston bore so that pressure loading does not result in sufficient distortion of the piston bore to lose the piston sealing relation in its bore.

DETAILED DESCRIPTION OF THE PREFERRED EMBODIMENT

Figure 3:
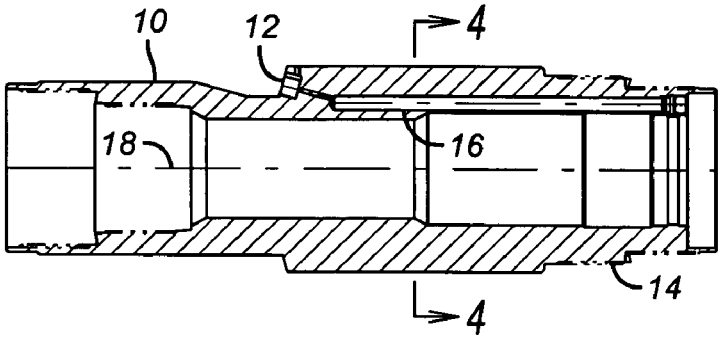
(PRIOR ART) FIG. 3
FIG. 3 is a section view of a prior art upper section of an SSSV.
Figure 4:
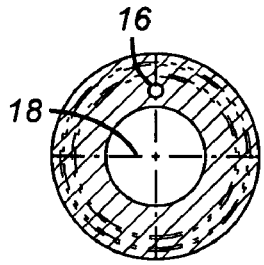
(PRIOR ART) FIG. 4
FIG. 4 is a section view along lines 4-4 of FIG. 3.

FIG. 3 shows a section through a prior art SSSV showing the upper body 10 and a connection 12 for a control line from the surface (not shown). At the lower end is a two step male pin thread 14. Running through the wall of the upper body is a piston bore 16. Residing within this bore but not shown is a piston that is responsive to pressure application and removal as described above. Looking at the section view of FIG. 4 the piston bore 16 is located with respect to the longitudinal axis 18. From these two FIGS., it can be seen that the result of very high internal working pressures in the vicinity of 20,000 PSI or more can result in distortion of the piston bore 16 because the wall of the housing 10 is not uniform and has what is essentially a void in one portion of the wall that weakens it in that location and causes a disproportionate amount of deformation there. Since the piston seals (not shown) need to maintain a pressure differential across the piston for proper movement of the flow tube (not shown) ovality of the piston bore 16 will reduce or remove the ability of the piston seals to retain pressure differential. The net result of piston seal failure is an inability to operate the valve causing it to go to its fail safe position which is generally closed.

Figure 5:
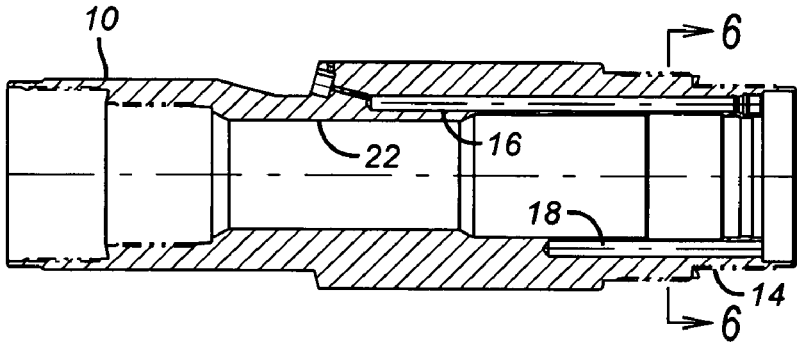
FIG. 5 is a section view of the upper portion of an SSSV showing the depth of additional bores adjacent the piston bore.
Figure 6:
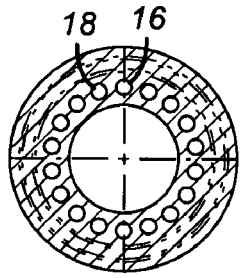
FIG. 6 is a section along lines 6-6 of FIG. 5.

FIGS. 5-8 illustrate two solutions to this problem. In FIGS. 5-6 there are additional blind bores 18 that are preferably parallel to piston bore 16. In this solution, the additional holes 18 are uniformly spaced about the circumference starting from one side of the piston bore 16 and going all the way around to the other side of the piston bore 16 to distribute and minimize the distortion in each of the bores including the piston bore 16. In this example, there are 17 such bores 18.

Figure 7:
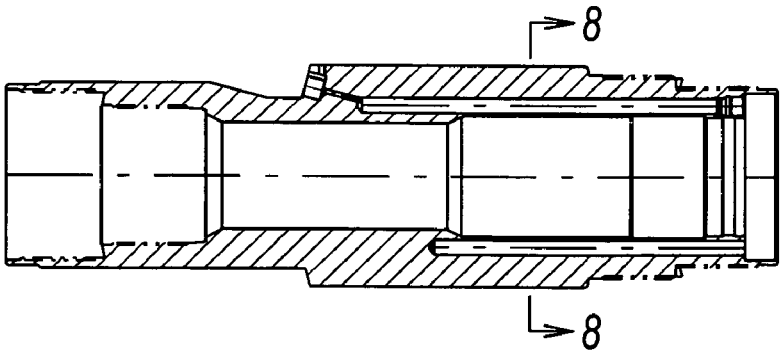
FIG. 7 is an alternative to FIG. 5 showing fewer but deeper bores.
Figure 8:
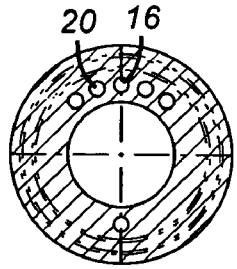
FIG. 8 is a view along lines 8-8 of FIG. 7.

FIGS. 7-8 illustrate a variation where there are fewer blind bores 20 but these holes are disposed close to piston bore 16 and preferably on both sides of piston bore 16 within a 90 degree arc. When fewer holes are used but positioned close to piston bore 16 on either side, the major change in section is moved to the outer holes and away from the piston bore 16 the intent being to concentrate the stresses and thus the distortion at these outer holes and not at the piston bore 16 thus reducing the distortion at the piston bore 16.

Those skilled in the art will appreciate that the goal of the solutions offered is to minimize or eliminate distortion of piston bore 16 due to high internal pressures in main bore 22 which create this distortion because the presence of the piston bore 16 is a weak spot in what is already a fairly thin wall near the pin threads 14. Adding the blind bores has the objective of making the housing 10 wall deflection more uniform in the vicinity of the piston bore 16 so as to share the distortion effects, if any, from very high working pressures. Clearly the solution in FIG. 6 makes the entire wall of housing 10 uniform in the vicinity of the piston bore 16 and is more likely to arrive at the ideal solution of minimal or no bore distortion in piston bore 16 as any tendency to distort is not concentrated in a single bore 16 in the housing 10 as shown in the prior art view of FIG. 4. Instead, FIG. 6 represents the more comprehensive solution of sharing the stress from internal pressurization. It is more costly to produce since more blind bores 18 are used than in the FIG. 8 alternative using blind bores 20 despite the fact that the depth of fewer bores is preferably greater than the depth of an array using more blind bores. While the solution which seeks to divert the major portion of the total distortion to the outer holes on each side of the piston bore 16 is considered less effective in reducing the distortion in bore 16 than the solution which seeks to distribute the distortion among the many holes, the economics of using fewer holes is self evident and this second solution is also effective in reducing the distortion in piston bore 16.

Computer controlled milling machines can be employed to produce many variations in number, depth, spacing, shape and angular orientation of the blind bores. The enhanced performance can be predicted in advance using known finite element method analysis.

The proposed solution encompasses variation of the bore diameter with the larger diameter bores preferably closer to the piston bore 16. While the longitudinal axes of the blind bores are preferably parallel, variations are envisioned where some skewing of the longitudinal axes is envisioned with offsets in the order of 15 degrees or less from adjacent blind bores or of all the blind bores with respect to the longitudinal axis 18 either in the same orientation or differing orientations. For example, the longitudinal axes of all the blind bores can parallel to each other while at the same time skewed with respect to axis 18. The most economical design to machine would be the fewest number of blind bores parallel to each other and to axis 18. Bores can have identical or varying depths.

Figure 1:
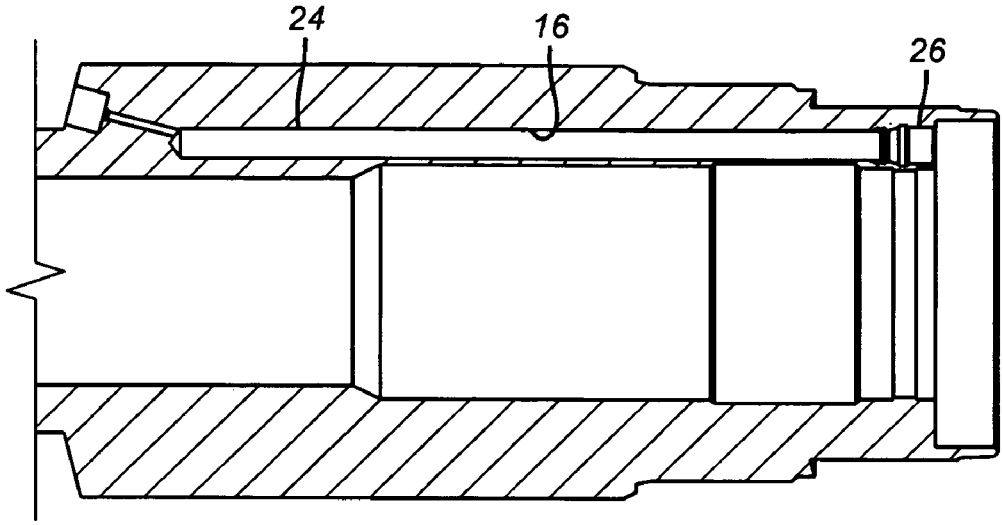
FIG. 1 is a section view of a sleeve inside a piston bore in the pin portion of a housing for a SSSV.
Figure 2:
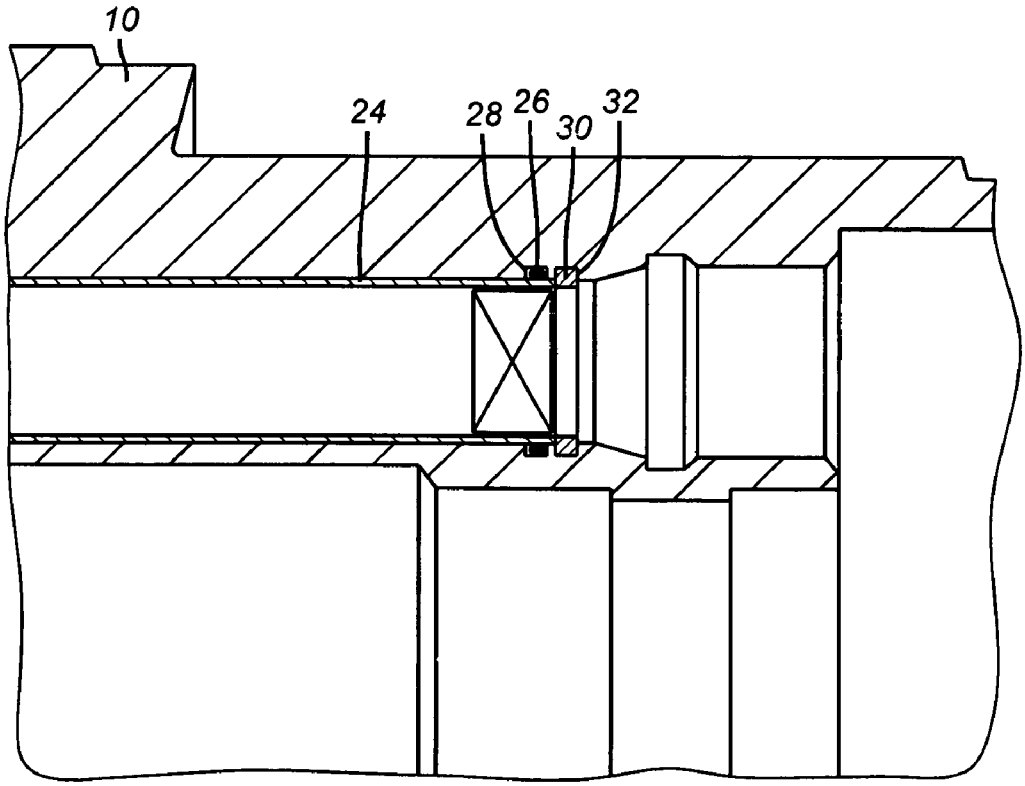
FIG. 2 is a close up of the lower end of the sleeve of FIG. 1.

FIGS. 1-2 illustrate another solution to the same problem. For this solution, the piston bore 16 has an internal sleeve 24 in which the piston (not shown) travels back and forth. As shown in the close up of FIG. 2 a seal 26 held in a groove 28 in housing 10 prevents pressure loss around the outside of sleeve 24. Sleeve 24 is inserted through the lower end of bore 16 and slides in because there is a clearance between its outside dimension and the bore dimension of piston bore 16. The seal 26 spans this clearance to seal it off. Alternatively, sleeve 24 can be pressed in for no clearance and the elimination of seal 26. Once the sleeve 24 is fully inserted, a snap ring or other known fastener equivalent 30 is installed in a groove 32 in bore 16 to keep the sleeve 24 from shifting longitudinally.

The objective here is to allow the piston bore 16 to distort while the sleeve 24 remains unaffected due to the clearance between them.

Those skilled in the art will appreciate that the proposed solution in FIGS. 1-2 can be used with the solution in FIGS. 6 or 8 or separately. The desired result in any case is to maintain sealing integrity of the seal around the piston that operates the flow tube in a SSSV or in other applications with high internal working pressures exceeding 20,000 PSI where housings have piston bores regardless of the nature of the downhole device.

The above description is illustrative of the preferred embodiment and many modifications may be made by those skilled in the art without departing from the invention whose scope is to be determined from the literal and equivalent scope of the claims below.

We claim:

1. A subsurface safety valve, comprising:

a housing having a main bore and a piston bore in a wall thereof said piston bore extending from a connection adapted to receive a control line and further containing a piston and a closure bias acting on said piston; and at least one additional blind bore axially overlapping and circumferentially spaced within said wall from said piston bore, said blind bore containing only fluid and out of fluid communication from said piston bore.

2. A subsurface safety valve, comprising:

a housing having a main bore and a piston bore in a wall thereof said piston bore extending from a connection adapted to receive a control line and further containing a piston and a closure bias acting on said piston; and at least one additional blind bore within said wall, said blind bore containing only fluid and out of fluid communication from said piston bore;

said additional bore is within 45 degrees of said piston bore;

said additional bore reduces a tendency of said piston bore to deform when said main bore is pressurized.

3. A subsurface safety valve, comprising:

a housing having a main bore and a piston bore in a wall thereof said piston bore extending from a connection adapted to receive a control line and further containing a piston and a closure bias acting on said piston; and at least one additional blind bore within said wall, said blind bore containing only fluid and out of fluid communication from said piston bore;

said at least one additional bore comprises a plurality of bores, whereupon the presence of said additional bores reduces the tendency for the piston bore to deform to a point of leakage past said piston when said main bore is pressurized.

4. The valve of claim 3, wherein:

said additional bores are disposed over substantially the entire circumference of said wall.

5. The valve of claim 3, wherein:

said additional bores are disposed on both sides of said piston bore within a 90 degree arc.

6. The valve of claim 3, wherein:

said additional bores are all the same diameter.

7. The valve of claim 3, wherein:

said additional bores are equally spaced from each other about said piston bore.

8. The valve of claim 3, wherein:

said additional bores are parallel to each other.

9. The valve of claim 3, wherein:

said additional bores are parallel to said piston bore.

10. The valve of claim 3, wherein:

said additional bores vary in diameter or shape.

11. The valve of claim 3, wherein:

said additional bores are randomly spaced.

12. The valve of claim 3, wherein:

said additional bores have one of the same depth or different depths.

13. A subsurface safety valve, comprising:

a housing having a main bore and a piston bore in a wall thereof said piston bore extending from a connection adapted to receive a control line and further containing a piston and a closure bias acting on said piston; and at least one additional blind bore within said wall, said blind bore containing only fluid and out of fluid communication from said piston bore;

said additional bore reduces a tendency of said piston bore to deform when said main bore is pressurized.

* * * * *